US007232146B2

(12) United States Patent
Papon

(10) Patent No.: US 7,232,146 B2
(45) Date of Patent: Jun. 19, 2007

(54) SNOWBOARD BINDING

(75) Inventor: Christophe Papon, Montferrat (FR)

(73) Assignee: Skis Rossignol S.A., Voiron (FR)

( * ) Notice: Subject to any disclaimer, the term of this patent is extended or adjusted under 35 U.S.C. 154(b) by 127 days.

(21) Appl. No.: 10/973,453

(22) Filed: Oct. 27, 2004

(65) Prior Publication Data

US 2005/0104331 A1 May 19, 2005

(30) Foreign Application Priority Data

Nov. 17, 2003 (FR) ..... 03 50846

(51) Int. Cl.
*A63C 9/00* (2006.01)
*A63C 9/14* (2006.01)

(52) U.S. Cl. ..... 280/617; 280/619

(58) Field of Classification Search ..... 280/11.3, 280/617, 619, 14.22, 11.31, 14.21, 623, 626
See application file for complete search history.

(56) References Cited

U.S. PATENT DOCUMENTS

| | | | | |
|---|---|---|---|---|
| 5,758,895 | A * | 6/1998 | Bumgarner | 280/607 |
| 6,416,075 | B1 * | 7/2002 | Laughlin et al. | 280/624 |
| 6,554,297 | B2 * | 4/2003 | Phillips et al. | 280/14.22 |
| 6,575,490 | B1 * | 6/2003 | Laughlin | 280/618 |
| 6,709,003 | B2 * | 3/2004 | Laughlin et al. | 280/623 |
| 2002/0190503 | A1 | 12/2002 | Laughlin et al. | |
| 2003/0098569 | A1 | 5/2003 | Gonthier | |

* cited by examiner

*Primary Examiner*—Christopher P. Ellis
*Assistant Examiner*—Brian Swenson
(74) *Attorney, Agent, or Firm*—Browdy and Neimark, PLLC

(57) ABSTRACT

A snowboard binding that includes a strap (10) for gripping the front part of a foot, the strap being capable of pivoting relative to an axis (11) substantially perpendicular to the median longitudinal plane of the binding. The snowboard binding includes a stop for limiting the rearward pivoting of the strap (10) relative to the axis.

3 Claims, 1 Drawing Sheet

SNOWBOARD BINDING

TECHNICAL FIELD

The invention relates to the field of gliding sports and, more precisely, to that of snowboards.

More particularly, it relates to a snowboard binding having advantageous arrangements in terms of its front gripping strap.

PRIOR ART

Generally speaking, snowboarding may be practised either with hard boots or with soft boots. In the latter case, the binding used generally includes a baseplate secured to the board and arrangements interacting with the boot. The binding includes a plurality of straps passing over the boot and clamping the latter onto the baseplate, and usually a rear spoiler for receiving rearward bearing forces.

The majority of bindings include two straps, namely a "rear" strap passing over the instep, and a "front" strap gripping the front of the boot, substantially in the region of the metatarsophalangeal joint.

This type of "strap" binding does not allow the boot to be placed into it totally automatically, as is the case with "step-in" bindings, which are compatible with stiffer boots. However, there is felt to be a need to facilitate the operations of placing the boot in the binding, even if it is still necessary to tighten the straps manually.

In point of fact, in most strap bindings, the front strap is able to pivot relative to a transverse axis so that it can tilt from front to back. This tilting is desired to allow adaptation to boot size and shape.

Certain users also have to be able to move the gripping strap slightly in order to optimize gripping, as a function of the morphology of their feet. This pivoting capability of the front strap means that it may be folded down rearward, over the front face of the baseplate for receiving the bearing force from the sole. This is therefore an inconvenience for the user, because even before positioning his foot on the baseplate he has to clear the relevant space by raising the strap and moving it out of the way.

The object of the invention is to provide a binding that leaves the upper face of the baseplate permanently free in order to allow the first phase of placing the boot in the binding without user intervention on any part of the binding. A further object is to allow pivoting of the front strap, particularly until it is in contact with the baseplate, by means of a forward movement in order to reduce the amount of space taken up by the binding when the board is being transported.

SUMMARY OF THE INVENTION

The invention therefore relates to a snowboard binding that includes a strap for gripping the front part. In a known manner, this strap is capable of pivoting relative to an axis substantially perpendicular to the median longitudinal plane of the binding.

According to the invention, this binding includes means for limiting the rearward pivoting of this strap relative to said axis.

In other words, the invention consists in preventing rearward tilting of the strap so as to leave the upper face of the baseplate free to allow the user to place his sole in the binding without inconvenience.

In a particular embodiment, the means for limiting the pivoting of the strap are formed by a protrusion of the end of at least one of the straps. This protrusion interacts with a portion integral with the baseplate, in order to abut against the latter when the strap is in the maximum rear pivot position.

In practice, the characteristic means that limit pivoting may be present on only one side of the strap or else on both sides.

In a particular embodiment, the protrusion zone constitutes a region of greater average distance relative to the pivot point of the end of the strap. In other words, the end of the strap has a protuberance forming a swelling that, because of its size, blocks pivoting of the strap by forming a stop on the baseplate.

According to another characteristic of the invention, the binding may also include means allowing the longitudinal displacement of the pivot point or points of the strap relative to the baseplate. Thus, the strap is able not only to pivot but also to move longitudinally in translation in order to vary the way in which it bears on the boot.

In this case, the portion of the baseplate that forms the stop may advantageously have a tilt substantially parallel to the direction of longitudinal displacement of the strap's pivot point.

In other words, the bearing zone forming the stop and receiving the strap's protrusion forms a surface that is tilted, preferably toward the front of the baseplate, this tilt having the same value for the various longitudinal anchoring positions on the strap on the side of the baseplate, such that the rearward pivot limit position remains substantially the same irrespective of the longitudinal position of the strap.

BRIEF DESCRIPTION OF THE DRAWINGS

The way in which the invention is implemented and the advantages arising therefrom will become clearly apparent from the following description of the embodiment, on the basis of the appended figures, in which.

IMPLEMENTATION OF THE INVENTION

As stated above, the invention relates to a snowboard binding for receiving "soft" boots.

Figure 1:
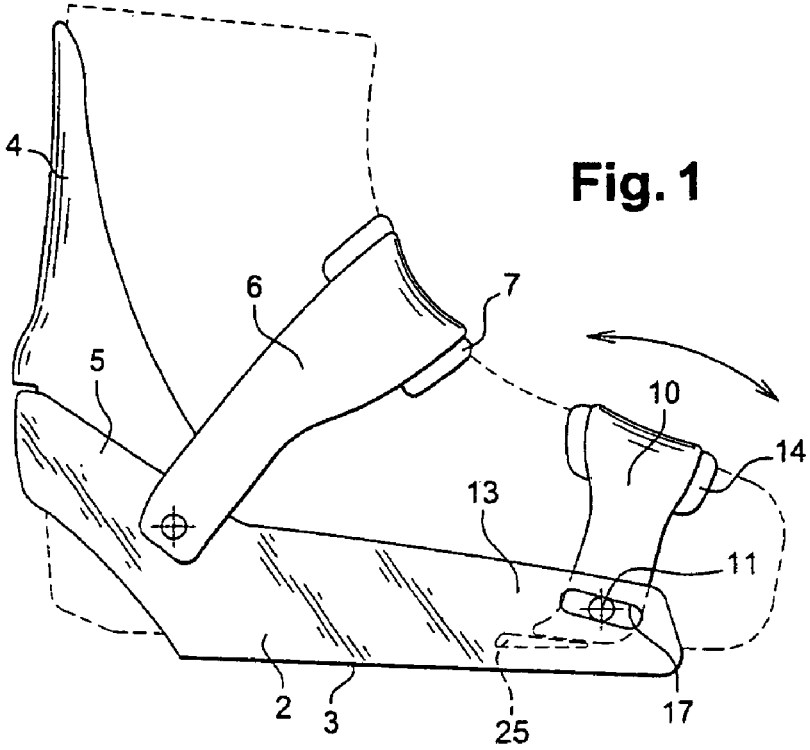
FIG. 1 is a side view of a binding according to the invention.

As shown in FIG. 1, the binding has a baseplate 2 whose lower face 3 is intended to come into contact with the topsheet of the board, directly or via an adjustment disk or any other complementary device. At the rear, this binding includes a spoiler 4 for accommodating the bearing forces from the boot. This spoiler 4 is, in the example illustrated, mounted in an articulated manner relative to a heel loop 5. This heel loop also receives a strap 6 which is located substantially at the instep and includes a comfort zone 7 for reducing the pressure exerted by the strap 6 on the foot during tightening of the strap.

According to the invention, the binding also includes a front strap 10 capable of pivoting relative to the baseplate 2 at several pivot points 11 indicated on either side of the baseplate at the protruding regions 13 of this baseplate. As already explained, this pivoting is designed, on the one hand, to allow folding-down of the strap during transportation and, on the other hand, and principally, to allow adjustment of the position of the top part of the strap and, in particular, of the bearing pad 14 on the optimum zone of the upper face of the boot.

In the embodiment illustrated, this pivot point 11 is able to move longitudinally within the aperture 17 provided in the side zone 13.

A multiplicity of architectures may be provided in order to allow displacement of these pivot points and their blocking relative to the baseplate, without departing from the scope of the invention.

Figure 2:
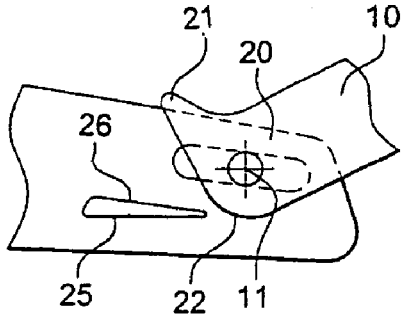
FIGS. 2 and 3 are detail and side views of the zone of interaction of the end of the strap with the baseplate.

According to one characteristic of the invention, and as illustrated in FIG. 2, the strap 6 has, at its end 20, a protrusion 21 that forms a protuberance relative to the remainder 22 of the end of the strap, which in the embodiment illustrated has a rounded shape forming an arc of a circle substantially at the center of the pivot point 11.

This protrusion 21 is capable of interacting with a zone forming a stop 25, integral with the baseplate. This stop 25 may be formed by a portion of the baseplate obtained by molding or, alternatively, by an attached piece on the inner face of the side zone 13 of the baseplate.

In the embodiment illustrated, this stop 25 has a wedge shape, the upper face 26 of which is capable of receiving bearing forces on its inner face 27 from the protrusion 21.

Figure 3:
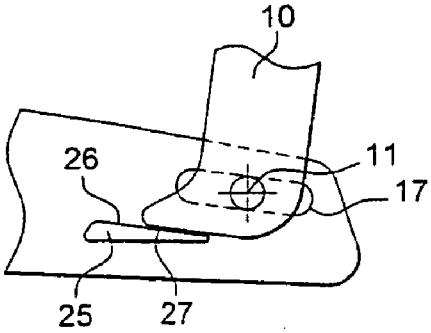

Thus, as illustrated in FIG. 3, when the strap 10 has pivoted rearward, the surface 17 of the strap is in contact with the front of the upper face of the stop 25, thereby preventing further rearward pivoting of the strap 10. In practice, the limit portion of the strap toward the rear is substantially vertical.

Figure 4:
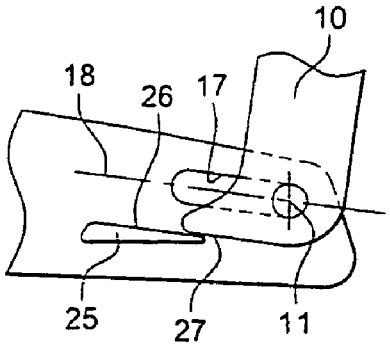
FIG. 4 is a side and then a detail view, similar to FIG. 3, in which the strap is in the furthest forward longitudinal position.

As illustrated in FIG. 4, the stop 25 may have sufficient length to be active irrespective of the longitudinal position of the pivot point 11 after translational movement into the aperture 17.

The tilt of the upper face 26 of the stop is chosen so as to be substantially parallel to the direction of the axis 18 of the aperture 17. In this way, the tilt of the zone of contact between the strap and the stop remains substantially constant, such that the rear pivot limit position of the strap remains the same irrespective of the longitudinal position of the strap 10.

Of course, the shape of the upper surface 26 of the stop may be adapted if the aperture 17 is not substantially rectilinear.

As already stated, the characteristic device may be installed either on one side of the strap or else on both sides, at each of the pivoting ends of the strap.

It will be preferred to generate the stop effect on one side if it is desired to use the existing strap portions and, in particular, those portions that include the locking means. It will, however, be possible to choose to have pivot limitation means on each side of the strap if it is desired to obtain the effect sought even when the two parts of the strap are detached and the locking means are not engaged.

From the aforesaid it emerges that the binding according to the invention has the advantage of leaving the boot-in-binding zone free while retaining a pivoting front strap, which facilitates the operation of placing the boot in the binding.

The invention claimed is:

1. A snowboard binding that includes a strap (10) for gripping the front part of the foot, said strap being capable of pivoting relative to an axis (11) substantially perpendicular to the median longitudinal plane of the binding, which includes means for limiting the rearward pivoting of said strap (10) relative to said axis, wherein the rearward pivot limit position of the strap (10) is substantially vertically aligned with said axis (11), wherein said binding further comprises a baseplate and the means for limiting the pivoting of the strap (10) are formed by a protrusion (21) of one end of the strap interacting with a portion (25) integral with the baseplate, in order to abut against the portion when the strap (10) is in the rearward pivot limit position, said binding also includes means for allowing the longitudinal displacement of a pivot point or points (11) of said strap (10) relative to the baseplate (2), and said means for limiting the rearward pivoting of said strap cooperate with said means for allowing the longitudinal displacement of the pivot point or points of said strap relative to the baseplate to cause the limit position of said strap (10) to be substantially vertically aligned with said axis (11) for all longitudinal displacement positions of the pivot point or points (11) of said strap (10) relative to the baseplate (2).

2. Snowboard binding as claimed in claim 1, wherein the protrusion (21) constitutes a region of greater average distance relative to the pivot point (11) of the end of the strap relative to the baseplate.

3. Snowboard binding as claimed in claim 1, wherein said portion (25) of the baseplate has an upper face (26) that is inclined substantially parallel to the direction (18) of longitudinal displacement of the pivot point or points.

* * * * *